United States Patent [19]

Barker et al.

[11] Patent Number: 4,783,066

[45] Date of Patent: Nov. 8, 1988

[54] PHOTOGRAPHIC FILM STACKING DEVICE

[75] Inventors: Paul D. Barker, Kirkland; David L. Davis, Indianola; Allen E. Fleckenstein, Bellevue; Hans-Ulrich Schlapfer, Seattle, all of Wash.

[73] Assignee: CX Corporation, Seattle, Wash.

[21] Appl. No.: 903,542

[22] Filed: Sep. 2, 1986

[51] Int. Cl.[4] ..... B65H 29/44

[52] U.S. Cl. ..... 271/180; 271/213

[58] Field of Search ..... 271/177, 180, 213

[56] References Cited

U.S. PATENT DOCUMENTS

| | | | |
|---|---|---|---|
| 1,960,667 | 5/1934 | Hutt et al. . | |
| 2,604,167 | 7/1952 | Oliver . | |
| 4,072,074 | 2/1978 | Romagnoli . | |
| 4,290,594 | 9/1981 | Lüdemann | 271/180 |
| 4,674,934 | 6/1987 | Honger | 271/177 X |

FOREIGN PATENT DOCUMENTS 2758979 7/1979 Fed. Rep. of Germany .

*Primary Examiner*—Richard A. Schacher

*Attorney, Agent, or Firm*—Christensen, O'Connor, Johnson & Kindness

[57] ABSTRACT

A film strip stacking device is provided for use in an order finishing station in conjunction with the negative cutter to accept film strips from the negative cutter which cuts the film into strips. The strips are collected into a stack which can then be loaded into a film sleeve prior to return to the customer. The film strip stacker of the present invention includes a channel divided into an upper and lower portion. The upper portion being adapted to receive initially the film from the negative cutter and including parallel rails movable to contact the film strip after it is cut and while it is in the upper portion of the channel and force the film to deform sufficiently to snap past the shelf members supporting the film into the lower portion of the channel. A pusher blade is movably mounted on the base of the film stacker and operable to contact an end of the film stack to push the stack out of the channel and into a film sleeve held in communication with the lower portion of the channel. The rails contact the edges of the film where there is no image to minimize the potential for damage to the image-containing portions of the film strip. Preferably, a sleeve opener mechanism is provided in conjunction with the stacker and operable in timed relation with the pusher blade to open the film sleeve to allow easy entry of the stack into the film sleeve as the pusher moves the stack from the second channel into the film sleeve. Also, the operation of the rails, the pusher blade, and the sleeve opener are all controlled in timed relation to the action of the knife in the negative cutter.

7 Claims, 4 Drawing Sheets

PHOTOGRAPHIC FILM STACKING DEVICE

BACKGROUND OF THE INVENTION

This invention relates to an apparatus for handling photographic film negatives and more particularly relates to a device for stacking strips of film for placement into an envelope for delivery to a customer.

In the commercial processing of photographic film it is necessary to return the developed film or negatives to the customer for use in ordering reprints. Typically, the film is processed in continuous roll form. After processing the film is cut into strips, usually four frames long, and the strips constituting one order are collected together and placed into an envelope called a film sleeve. The sleeve filled with negatives is part of the order consisting of prints, negatives, and envelope that is collected into a set of delivery to the customer.

While several devices are available for stacking paper and other sheet items, the handling of photographic film is unique due to the care that must be taken with the film to prevent tearing or scratching. Since the primary purpose of returning the film negatives to the customer is so that the customer will have them available for obtaining reprints of any photographs that they desire, it is necessary that the negatives be returned to the customer in excellent condition so that the reprints made from the negatives will be as good as the original prints. For this reason a unique handling apparatus is required that maintains the image area of the film free of scratches or blemishes that may be caused by the handling apparatus.

It is an object of the present invention to provide a film strip handling apparatus that is capable of stacking a series of film strips in preparation for loading the film strips into a film sleeve. It is a further object of the invention to provide such an apparatus that handles the film with minimum contact with the image-bearing areas of the film and which is easily adaptable for use with a negative cutter to accept the film strips directly from the negative cutter.

It is also an object of the present invention to provide a film strip stacker that is capable of handling different film widths with or without tabbing and which maintains control over the film strips during the entire collecting and stacking procedure.

SUMMARY OF THE INVENTION

In accordance with the above-stated objects a film strip handling apparatus is provided that includes guide means monted on a base and cooperable with a negative cutter for accepting film strips from the negative cutter and guiding them into a stacking position. A film stacking means is cooperably mounted on the guide means and operable to engage the edges of the film strip to move it from the stacking position into the stack. Channel means are mounted adjacent the guide means to receive the film strips from the guide means and hold the film strips until a predetermined number of film strips have been stacked in the channel means. A pusher means is movably mounted on the base and is operable to engage one end of the film strip stack to move the stack out of the guide means and into a waiting film sleeve.

Preferably, the stacking means simultaneously engages opposing edges of the film strip and moves both vertically and laterally to push the film strips down and laterally into the stack. Preferably, the film stacker operates in timed synchronization with the negative cutter.

BRIEF DESCRIPTION OF THE DRAWINGS

The operation and advantages of the present invention will be better understood by those of ordinary skill in the art and others upon reading the ensuing specification taken in conjunction with the appended drawings wherein.

DETAILED DESCRIPTION OF THE PREFERRED EMBODIMENT

Figure 1:
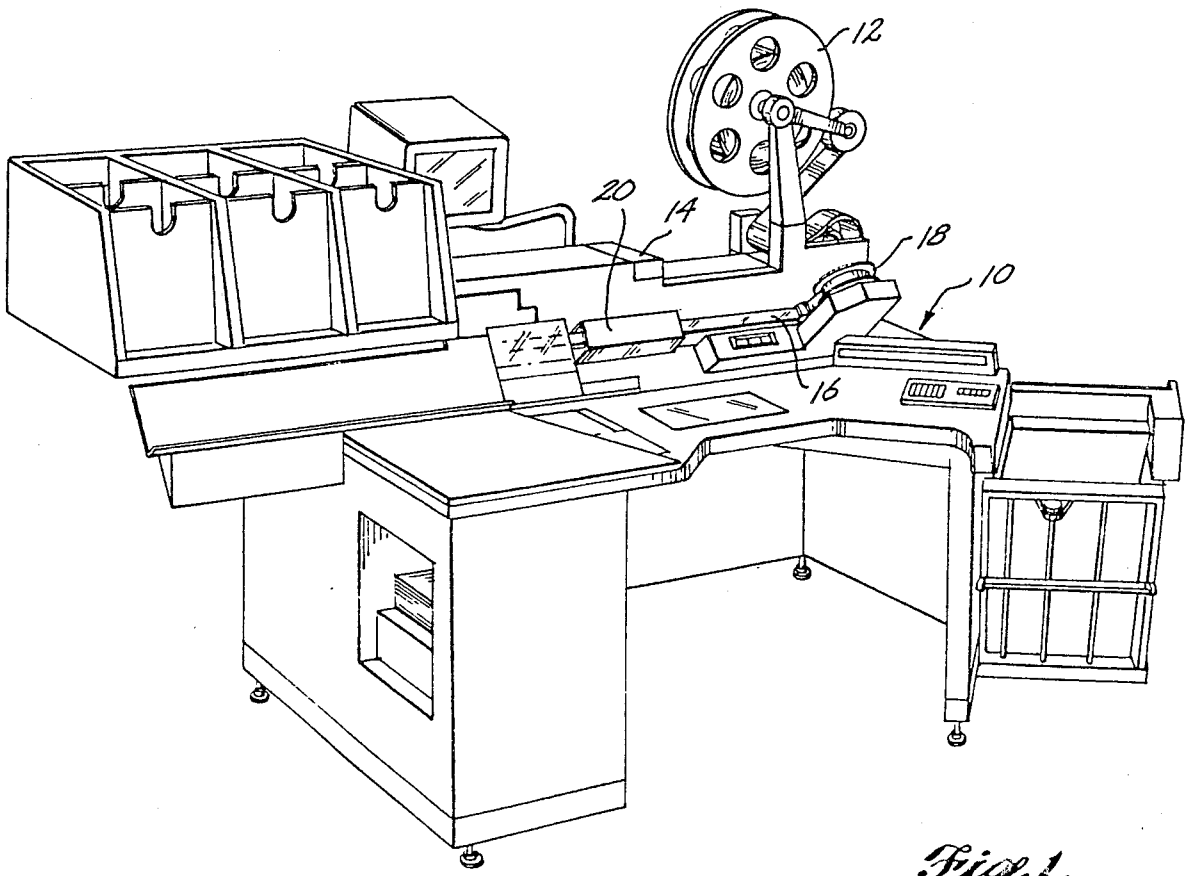
FIG. 1 is an isometric view of an order finishing station including the film strip stacker of the present invention.

FIG. 1 shows an embodiment of an order finishing station 10 in which the developed film, prints made from that film, and customer envelopes are brought together into a set that can be returned to the customer. The order finishing station has several components and includes apparatus for mounting a reel 12 of photographic prints and a print cutter 14 to cut and package the prints. Also, a negative cutter 16 accepts a continuous reel 18 of developed negatives and cuts the negatives into strips. The strips of negatives belonging to one order are then collected together for return to the customer after being matched with the prints made from those negatives. The prints and the negatives are combined together in a first envelope and all of these components are placed into a second envelope that has customer identification information on it so that using information obtained by the station as to the number of prints and type of film the order can be priced and returned to the proper customer. The order finishing station shown in FIG. 1 includes a film strip stacker 20 which accepts the negative strips from the negative cutter 16, and gathers the cut strips into a stack which can be then placed into an envelope or film sleeve so that they can be returned as a unit to the customer.

Figures 2, 7:
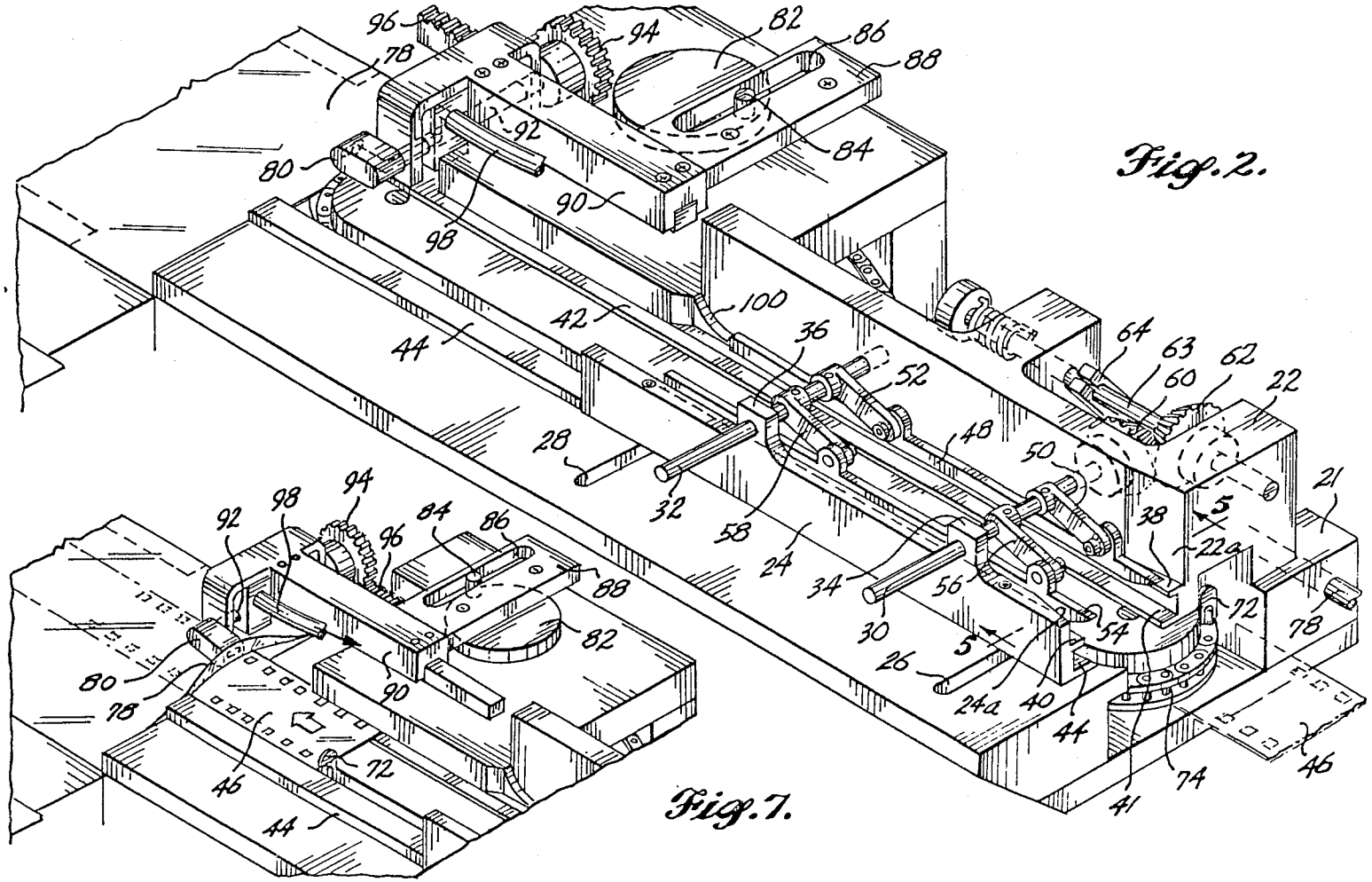
FIG. 2 is an isometric view of one embodiment of a film strip stacker made in accordance with the principles of the present invention.
FIG. 7 is an isometric view of a portion of the film strip stacker of FIG. 6 showing a stack of film strips being loaded into a film sleeve.

FIG. 2 illustrates a preferred embodiment of a film strip stacker suitable for use in the order finishing station of FIG. 1. The stacker includes a base 21 upon which is mounted a fixed guide rail assembly 22. A movable guide rail assembly 24 is mounted on the base 21 spaced from and parallel to the fixed guide rail assembly 22. The fixed guide rail and movable guide rail define a channel into which the strip of negatives from the negative cutter is introduced. The lateral spacing between the fixed guide rail assembly and the movable guide rail assembly can be changed by lateral movement of the movable guide rail assembly 24 along slots 26 and 28 formed in the base 21. First and second guide pins 30 and 32, respectively, extend from the fixed guide rail assembly 22 and pass through first and second mounting tabs 34 and 36 integrally formed in an upper edge of the movable guide rail assembly 24. The movable guide rail assembly 24 slides on the guide pins and is laterally movable to change the spacing between the fixed guide rail assembly 22 and the movable guide rail assembly 24. The variable spacing between the fixed and movable guide rails allows the film stacker to accept different sizes of film with or without tabbing.

Figure 3:
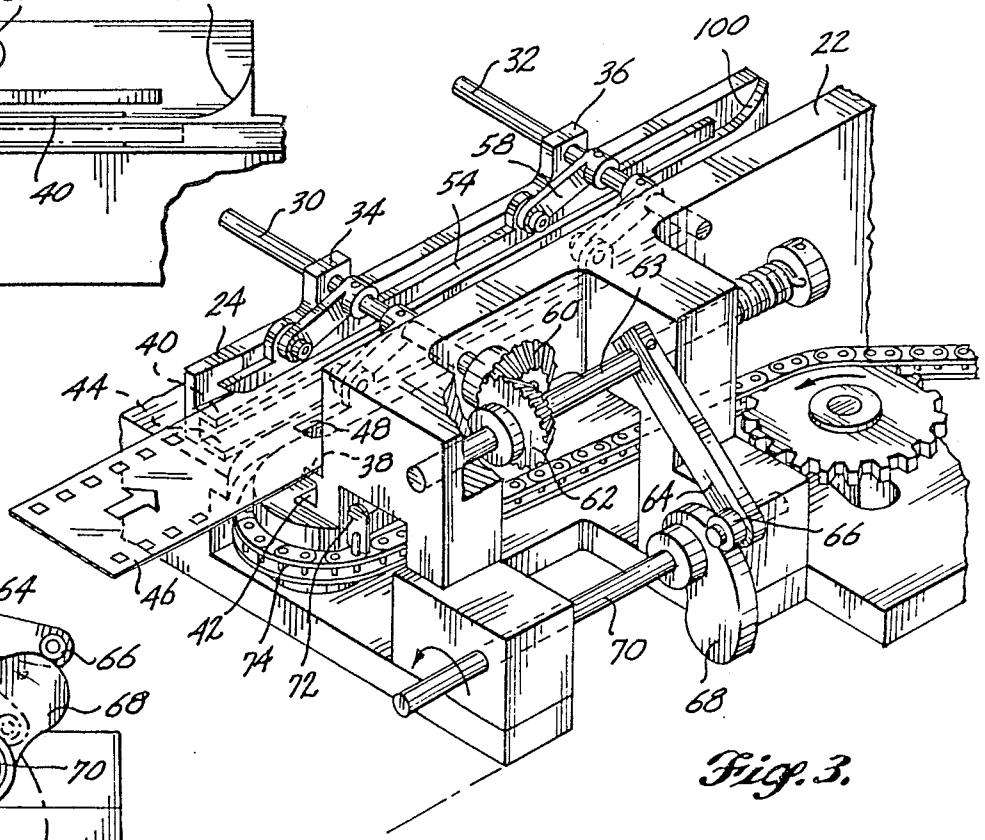
FIG. 3 is an isometric view of a portion of the film strip stacker of FIG. 2 showing the entry of a film strip into the apparatus.
Figure 4:
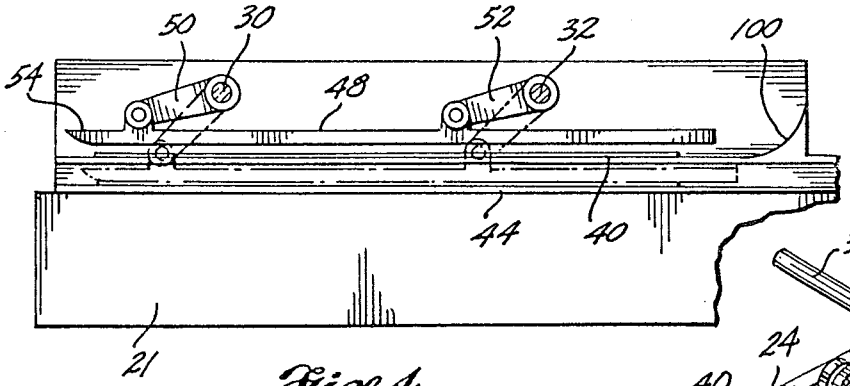
FIG. 4 is a side elevational view of a portion of the film strip stacker shown in FIG. 3.

A first upper shelf 38 extends orthogonally from the fixed guide rail assembly 22 and cooperates with a second upper shelf 40 that extends orthogonally from the movable guide rail assembly 24 to divide the channel defined by the guide rail assemblies into an upper portion and a lower portion. First and second lower shelves 42 and 44 extend respectively from the fixed and movable guide rail assemblies to define the bottom of the lower portion of the channel. As shown in FIG. 3 the film strip stacker accepts a film strip 46 as it exits the negative cutter. The film strip 46 rests on the upper shelves 38 and 40 which provide support for the edges of the film strip 46. A first rail 48 is positioned just above the first upper shelf 38 and is spaced from the shelf a sufficient distance to allow the film strip 46 to fit between the first upper shelf 38 and the first rail 48. The rail is laterally positioned so that it does not overlie the shelf but is inwardly positioned so that it is free to move vertically closely adjacent the shelf. As shown in FIG. 4, first drive link 50 is pivotally attached at its first end to a forward portion of the first rail and is fixed at its second end to the first guide pin 30. A first pivot link 52 is pivotally attached at its first end to the first rail 48 at a point spaced from the attachment of the first drive link 50 to the rail and a second end of the first pivot link 52 is fixed at its second end to the second guide pin 32 which is rotatably mounted on the base 21. A second rail 54 is parallel to and spaced from the first rail 48 and mounted above and closely adjacent the second upper shelf 40, again positioned so that it does not directly overlie the shelf so that the rail can move vertically closely adjacent the shelf. A second drive link 56 is pivotally attached at a first end to the second rail 54 and fixed at its second end to the first guide pin 30. A second pivot link 58 is pivotally attached at its first end to the second rail 54 and fixed at its second end to the rotatably mounted second guide pin 32. The rails 48 and 54 are therefore driven by rotation of the first guide pin 30 through the attachment of the first and second drive links to their respective rails. As the first guide pin is rotated the first and second drive links will swing with it forcing the rails in a downwardly and rearwardly sweeping motion. The first and second pivot links 52 and 58 travel with the motion of the rails and provide stability and control to the rails but do not drive the rail.

Figure 5:
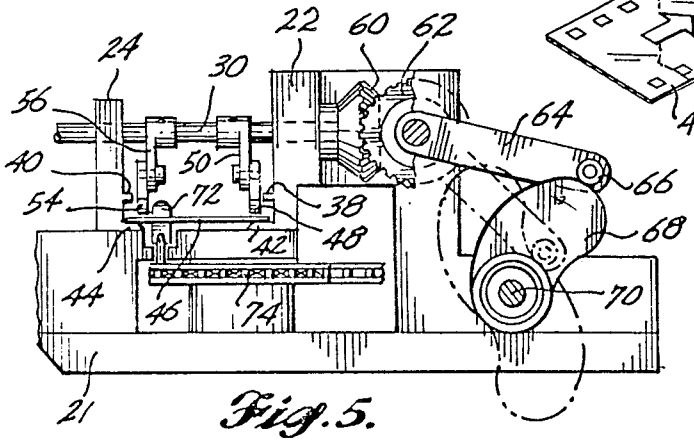
FIG. 5 is a sectional view along line 5—5 of FIG. 2 showing the drive portion of the stacking means.

As can be seen in FIG. 3 as the film strip 46 moves from the negative cutter to the film strip stacker it rests on the upper shelf members 38 and 40 and the rails 48 and 54 overlie the edges of the film strip 46. After the film strip has been positioned on the upper shelves and cut the rails are activated to make their downward movement engaging the edges of the film adjacent the upper shelf members and applying enough pressure on the film to bend the film enough to move it down past the upper shelf members with a snapping motion so that it then rests on the lower shelf members 42 and 44. The rails then move back up to their original position to allow entry of the next film strip on the upper shelf members. The motion of the rails is best seen in FIG. 4 which shows them moving between the upper and lower positions as dictated by the drive links 50 and 56. FIG. 5 is an end view of the film stacker showing the rails in their lowermost position having forced the film strip 46 into the lower portion of the guide channel so that the film is resting on the lower shelf members 42 and 44.

The movement of the rails is controlled by the rotation of the first guide pin 30 which, in turn, is driven by a bevel gear 60 fixed to the first end of the first guide pin 30. The bevel gear 60 is cooperably mated with a second bevel gear 62 fixed to a shaft 63 that, in turn, has fixed to it a control arm 64. The control arm 64 has a cam follower 66 mounted on its second end which rides on a cam member 68 fixed to a drive shaft 70. The drive shaft 70 is rotatably journaled in the base 21 and is drivingly associated with the knife drive of the negative cutter (not shown). The drive shaft 70 is tied to the knife so that as the knife rotates through its cutting sequence it drives the drive shaft 70 which, in turn, drives the cam member 68 and hence the rails 48 and 54 to move the film strip that is resting on the upper shelf members 38 and 40 to a position on the lower shelf members 42 and 44. The cam member 68, cam follower 66, and control arm 64 lengths and shapes are designed to accommodate the timing of the negative cutter knife so that the film strip is received from the cutter and after cutting it is stacked according to the speed of the negative cutter. FIG. 5 shows the action of the cam member 68 and cam follower 66 as they drive the rails 48 and 54. The movement of the cam member 68 as the drive shaft 70 turns is shown in its various positions by both the solid and dotted lines in FIG. 5.

A pusher blade 72 is mounted on a chain 74 so that the pusher blade 72 can rotate about its vertical axis. The chain 74 is driven by a sprocket 76 which, in turn, is driven by a stepper motor that is controlled by the end-of-order mark on the film strips. When the end-of-order is noted at the negative cutter a signal is sent to the stepper motor to drive the sprocket 76 and thereby the chain 74 to move the pusher blade 72 into position at the rear of a stack of negatives to push the stack of negatives to the left as viewed in FIG. 2 for insertion into a film sleeve 78 positioned at the exit end of the film strip stacker as shown in FIG. 7. The path of the chain 74 can be seen in FIG. 6 and the pusher is timed so that it pushes the stack out of the way prior to the introduction of the next film strip from the next order into the stacker. The rotatability of the pusher blade 72 insures that it will rotate into a proper angle of attack flat against the rear edge of the film strips to push them through the stacker without damaging the edge.

Figure 6:
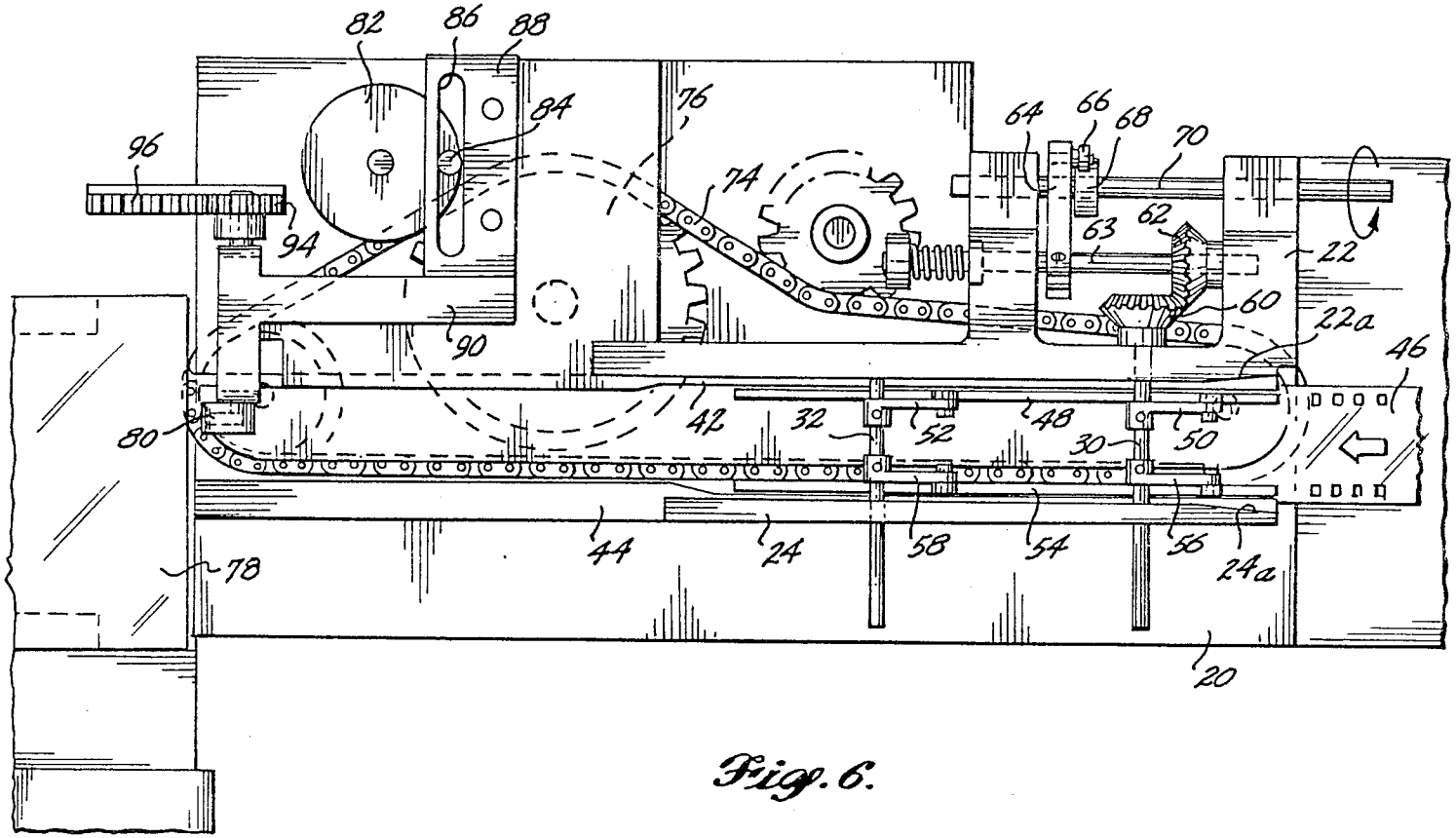
FIG. 6 is a plan view of the film strip stacker shown in FIG. 2.

The entrance of the film strip stack into the film sleeve is aided by a suction member 80 that assists in opening the end of the film sleeve 78 and holding it open while the film stack is inserted. The suction member 80 is shown in its initial position in FIG. 2 and in its final position in FIG. 7. Rotation of the suction member 80 is controlled by the movement of the chain 74 that carries the pusher blade 72. As best can be seen in FIGS. 2, 6, and 7 an independently controlled wheel 82 has a pin 84 vertically extending therefrom. The pin 84 is held captive in a slot 86 formed in a suction control arm 88 which, in turn, is affixed to a suction member carriage 90. As the wheel 82 rotates the pin 84 forces the suction control arm 88 to move to the left as viewed in FIG. 6 carrying the suction member carriage 90 with it. The suction member 80 is fixed to one end of a shaft 92 that has a pinion gear 94 fixed to its second end. The shaft 92 is journaled in the suction member carriage 90. As the suction member carriage 90 moves the pinion gear 94 is drawn over a rack 96 which causes the pinion gear 94 to rotate thereby causing rotation of the shaft 92 and hence rotation of the suction member 80. As the suction member 80 rotates it engages an upper edge of the film sleeve 78 positioned to receive the film strip stack. A vacuum line 98 is connected from a vacuum source (not shown) to the suction member 80 which causes the suction member 80 to attach itself to the upper edge of the film sleeve 78 carrying it with it as it rotates under control of the pinion gear 94. Rotation of the suction member 80 pulls the upper portion of the film sleeve 78 from the lower portion thereby forming an opening as shown in FIG. 7 which enables the film stack to more easily enter the film sleeve. The vacuum source is controlled such that once the film strip stack is inserted into the film sleeve 78 the vacuum is discontinued so that the sleeve is released from the suction member 80. Continued movement of the chain 74 carrying the pusher blade 72 causes further rotation of the wheel 82 which, in turn, moves the suction member carriage 90 to the right, as viewed in FIG. 6, back to its initial position ready for insertion of the next stack of film strips into a film sleeve. The action of wheel 82 and chain 74 are controlled to insure correct film sleeve loading after suction has opened film sleeve. In one embodiment a sensor is mounted adjacent the drive sprocket 76 and the sprocket teeth are counted to monitor rotation of the sprocket. A second sensor monitors the position of pusher blade 72. The signals from these two sensors are used to control the motor that drives sprocket 76 so that the suction member 80 is properly positioned to open the film sleeve at the time the pusher blade pushes the film stack into the sleeve.

As mentioned earlier, the adjustability of the movable guide rail assembly 24 permits use of the film strip stacker of the present invention with different sizes, i.e., width of photographic film with or without tabbing. In addition, the faces of the fixed guide rail assembly and the movable guide rail assembly are chamfered at their first ends 22*a* and 24*a* adjacent the upper shelf members 38 and 40 to form a widened entry channel for entry of the film strips into the stacker minimizing any potential damage to the forward end of the film strip.

In certain instances a customer will request that the film negative not be cut into strips but rather be returned to him in a continuous length. Whether or not the film strip is cut is determined by markings on the film strip itself to control the negative cutter. In order to accommodate the continuous length film strips the upper shelves 38 and 40 are formed at their rearmost ends to an upwardly curving surface 100 so that the film strip will ride up the upwardly directed curve ahead of the suction member carriage 90 for presentment of the film strip to the operator.

The spacing of the first and second rails 48 and 54 is chosen so that the rails do not engage the image-carrying portion of the film. In this way potential of damage to the image-carrying portions of the film due to contact by the rails is minimized. Further, the sweeping downward and rearward motion of the rails produces a less harsh contact with the film and minimizes the potential for film damage.

It is clear, therefore, that a film stacker for use in an order finishing station is adapted to receive film strips from a negative cutter and stack the film strips so that they can be simultaneously fed into a film sleeve prior to delivery back to the customer. The stacker includes a channel defined by upper shelves which initially accept the film strips from the negative cutter. A pair of spaced rails is provided that overlie the edges of the film strips. The rails are movable vertically to engage the film strips and to deform them sufficiently to snap them from the upper shelf to a position below the shelf into a channel defined by the lower shelf members. A pusher member controlled by the end-of-order mark on the film strips is operable to engage the rearward end of the stack of film strips and push them through the stacker longitudinally into a waiting film sleeve. Movement of the pusher member also controls a vacuum member which engages the film sleeve and opens it to ease the entry of the film stack into the film sleeve. The film strip stacker preferably engages only the edges of the film and does not engage the image-bearing portions of the film strip. Also, the stacking action is preferably synchronized with the action of the knife in the negative cutter so that the stacker operates only when the negative cutter is in operation. The upper shelf members are formed to direct a continuous strip of film that is uncut away from the stacker for ease of access by the operator. It will be understood by those of ordinary skill in the art and the others that while a preferred embodiment of the film stacker of the present invention has been described and illustrated several changes can be made to the illustrated embodiment without exceeding the scope of the present invention. Therefore, it will be understood that the invention should be defined solely with reference to the appended claims which follow.

The embodiments of the invention in which a property or privilege is claimed are as follows:

1. An apparatus for stacking strips of film comprising:

a base;

first and second channel-defining members mounted on said base in spaced parallel relationship to one another defining between them a channel;

first and second shelf members rigidly mounted on and extending orthogonally from, respectively, said first and second channel-defining members and constructed and arranged to divide said channel into an upper portion and a lower portion, said first and second shelf members being spaced from one another;

first and second elongate rails parallel to one another and spaced from one another, said rails movably mounted on said channel-defining members for movement from a first position in which said rails are located above, respectively, said first and second shelf members to a second position wherein said rails are located below said shelf members;

pusher means movably mounted on said base for movement through said lower portion of said channel in a first direction from a first end to a second end;

rail guide means associated with said rails and said channel-defining members for providing a component of motion of said rails in said first direction as said rails move from their first position to their second position; and control means associated with said rails and said pusher means for controlling the movement of said rails between said first and second positions and movement of said pusher means through said lower portion of said channel in a timed relationship to one another.

2. The apparatus of claim 1 wherein said first and second channel defining members are chamfered at a first end.

3. The apparatus of claim 1 , wherein said rail guide means includes:

a first guide pin mounted on said first and second channel-defining members transversely to said first channel;

first and second drive links fixed at a first end thereof to said first guide pin and each pivotally attached at a second end thereof to, respectively, said first and second rails; and drive means fixed to said first guide pin for rotating said first guide pin.

4. The apparatus of claim 1, wherein said second channel-defining member is movably mounted on said base for movement in a direction transverse to the elongate dimension of said channel so as to vary the width of said channel.

5. The apparatus of claim 1 further including a chain mounted for movement along the elongate dimension of said channel, said pusher means including a blade rotatably mounted on said chain and further including a sprocket drivingly associated with said chain for moving said chain through said channel.

6. The apparatus of claim 1, wherein an upper surface of the second end of said first and second shelf members is curved in a direction away from the lower portion of said channel.

7. An apparatus for stacking strips of film comprising:

a base;

first and second channel-defining members mounted on said base in spaced parallel relationship to one another defining between them a channel;

first and second shelf members rigidly mounted on and extending orthogonally from, respectively, said first and second channel-defining members and constructed and arranged to divide said channel into an upper portion and a lower portion, said first and second shelf members being spaced from one another;

first and second elongate rails parallel to one another and spaced from one another, said rails movably mounted on said channel-defining members for movement from a first position in which said rails are located above, respectively, said first and second shelf members to a second position wherein said rails are located below said shelf members;

pusher means movably mounted on said base for movement through said lower portion of said channel in a first direction from a first end to a second end;

control means associated with said rails and said pusher means for controlling the movement of said rails between said first and second positions and movement of said pusher means through said lower portion of said channel in a timed relationship to one another;

a first guide pin mounted on said first and second channel-defining members transversely to said first channel;

first and second drive links affixed at a first end thereof to said first guide pin and each pivotally attached at a second end thereof to, respectively, said first and second rails; and drive means fixed to said first guide pin for rotating said first guide pin.

* * * * *